US011572740B2

(12) United States Patent
Vasques et al.

(10) Patent No.: US 11,572,740 B2
(45) Date of Patent: Feb. 7, 2023

(54) DOWNHOLE PRODUCTION CASING STRING

(71) Applicant: Welltec Oilfield Solutions AG, Zug (CH)

(72) Inventors: Ricardo Reves Vasques, Allerød (DK); Satish Kumar, Brønshøj (DK); Line Bergmann, Nærum (DK)

(73) Assignee: Welltec Oilfield Solutions AG, Zug (CH)

( * ) Notice: Subject to any disclaimer, the term of this patent is extended or adjusted under 35 U.S.C. 154(b) by 335 days.

(21) Appl. No.: 15/039,146

(22) PCT Filed: Nov. 28, 2014

(86) PCT No.: PCT/EP2014/075892
§ 371 (c)(1),
(2) Date: May 25, 2016

(87) PCT Pub. No.: WO2015/079003
PCT Pub. Date: Jun. 4, 2015

(65) Prior Publication Data

US 2017/0016278 A1 Jan. 19, 2017

(30) Foreign Application Priority Data

Nov. 29, 2013 (EP) ..... 13195030

(51) Int. Cl.
*E21B 7/20* (2006.01)
*E21B 33/127* (2006.01)
(Continued)

(52) U.S. Cl.
CPC ..... *E21B 7/201* (2013.01); *E21B 7/20* (2013.01); *E21B 17/08* (2013.01);
(Continued)

(58) Field of Classification Search
CPC ..... E21B 17/08; E21B 17/10; E21B 17/1057; E21B 17/22; E21B 17/1078; E21B 7/20;
(Continued)

(56) References Cited

U.S. PATENT DOCUMENTS 3,476,415 A * 11/1969 Van Note, Jr. ..... E21B 17/046 285/396
3,560,060 A * 2/1971 Morris ..... E21B 17/1071 166/241.4
(Continued)

FOREIGN PATENT DOCUMENTS

CA 2 533 563 7/2007
CN 2573664 Y 9/2003
(Continued)

OTHER PUBLICATIONS

International Search Report for PCT/EP2014/075892 dated May 27, 2015, 4 pages.
(Continued)

*Primary Examiner* — David Carroll
(74) *Attorney, Agent, or Firm* — Nixon & Vanderhye P.C.

(57) ABSTRACT

The present invention relates to a downhole production casing string for insertion in a borehole in a reservoir, the downhole production casing string having a first end nearest a top of the borehole and a second end furthest away from the top, the downhole production casing string extending along a longitudinal axis and comprising at least one opening which during production allows hydrocarbon-containing fluid from the reservoir into the downhole production casing string, a plurality of casing parts having end sections and a base section between the end sections, the base section having an outer diameter, and at least one annular projecting element having an outer face and at least one helical groove arranged in or on the outer face and having an overall outer diameter which is larger than the outer diameter of the base
(Continued)

section. Furthermore, the invention relates to a downhole production casing string system for completing a well downhole and to a method of implementing a production casing string according to the invention.

18 Claims, 11 Drawing Sheets

(51) Int. Cl.
*E21B 17/08* (2006.01)
*E21B 17/10* (2006.01)
*E21B 17/22* (2006.01)

(52) U.S. Cl.
CPC ..... *E21B 17/1078* (2013.01); *E21B 17/22* (2013.01); *E21B 33/1277* (2013.01); *E21B 2200/06* (2020.05)

(58) Field of Classification Search
CPC . E21B 7/201; E21B 33/1277; E21B 2034/007
See application file for complete search history.

(56) References Cited

U.S. PATENT DOCUMENTS 4,529,045 A * 7/1985 Boyadjieff ..... E21B 19/16 173/141
4,664,206 A * 5/1987 Butler ..... E21B 17/22 175/325.2
5,139,094 A * 8/1992 Prevedel ..... E21B 7/068 175/61
5,697,442 A * 12/1997 Baldridge ..... E21B 17/10 166/177.4
6,349,779 B1 2/2002 Gilbert
2003/0127227 A1* 7/2003 Fehr ..... E21B 33/1208 166/306
2003/0136587 A1 7/2003 Boulet
2004/0026131 A1* 2/2004 Boulet ..... E21B 17/1064 175/325.3
2005/0092527 A1* 5/2005 Le ..... E21B 17/1007 175/325.6
2005/0109538 A1* 5/2005 Fisseler ..... E21B 17/1078 175/20
2005/0230105 A1* 10/2005 Valenti ..... E21B 43/12 166/242.3
2007/0163778 A1* 7/2007 Wheeler ..... E21B 17/042 166/241.6
2011/0114338 A1* 5/2011 Casassa ..... E21B 17/1078 166/382
2011/0266004 A1* 11/2011 Hallundbaek ..... E21B 33/1208 166/369
2011/0308817 A1* 12/2011 Ravensbergen ..... E21B 23/02 166/382
2012/0152523 A1* 6/2012 Hofman ..... E21B 17/1057 166/177.5
2012/0292043 A1* 11/2012 Thornton ..... E21B 17/1078 166/369
2013/0233620 A1* 9/2013 Rankin ..... E21B 17/1078 175/57

FOREIGN PATENT DOCUMENTS

CN 102272413 A 12/2011
EP 2 466 065 A1 6/2012
RU 31 146 U1 7/2003
SU 802506 2/1981
WO WO 93/25794 12/1993
WO WO 02/04781 1/2002
WO WO 2009/115829 9/2009

OTHER PUBLICATIONS

Written Opinion of the ISA for PCT/EP2014/075892 dated May 27, 2015, 7 pages.
Notification of the First Office Action dated Apr. 2, 2018 in Chinese Application No. 201480062240.2, with English Translation (16 pages).
European Examination Report dated May 24, 2018 in European Application No. 14 808 567.3 (5 pages).
Office Action of Substantive Examination dated Jun. 18, 2018 in Russian Application No. 2016123344/03(036509), with English translation (12 pages).
Notification of the Third Office Action dated Jul. 9, 2019 in Chinese Application No. 201480062240.2, with English translation, 15 pages.

* cited by examiner

DOWNHOLE PRODUCTION CASING STRING

This application is the U.S. national phase of International Application No. PCT/EP2014/075892 filed 28 Nov. 2014 which designated the U.S. and claims priority to EP Patent Application No. 13195030.5 filed 29 Nov. 2013, the entire contents of each of which are hereby incorporated by reference.

FIELD OF THE INVENTION

The present invention relates to a downhole production casing string for insertion in a borehole in a reservoir. Furthermore, the invention relates to a downhole production casing string system for completing a well downhole and to a method of implementing a production casing string according to the invention.

BACKGROUND ART

Oil and gas wells may have a variety of completion designs depending on the reservoir conditions. Most of the wells have a metal tubing, also called a casing, which is entered into a drilled borehole, and in some implementations the casing gets stuck, or the packer or annular barriers are not forming a tight zone isolation when set. This sometimes occurs due to the fact that the drilling operation results in a borehole having a plurality of projections which prevent free passage of the casing.

SUMMARY OF THE INVENTION

It is an object of the present invention to wholly or partly overcome the above disadvantages and drawbacks of the prior art. More specifically, it is an object to provide an improved casing string which is easier to implement in a borehole, also when the production casing string has annular barriers.

The above objects, together with numerous other objects, advantages and features, which will become evident from the below description, are accomplished by a solution in accordance with the present invention by a downhole production casing string for insertion in a borehole in a reservoir, the downhole production casing string having a first end nearest a top of the borehole and a second end furthest away from the top, the downhole production casing string extending along a longitudinal axis and comprising:

at least one opening which during production allows hydrocarbon-containing fluid from the reservoir into the downhole production casing string, a plurality of casing parts having end sections and a base section between the end sections, the base section having an outer diameter, and at least one annular projecting element having an outer face and at least one helical groove arranged in or on the outer face and having an overall outer diameter which is larger than the outer diameter of the base section.

The annular projecting element may be a casing collar connecting the casing parts.

The downhole production casing string as described above may further comprise at least one annular barrier.

Moreover, the annular projecting element may be arranged between two annular barriers.

Also, the annular projecting element may be part of an annular barrier.

The annular barrier may comprise a casing part, an expandable sleeve surrounding the casing part and having an inner sleeve face facing the casing part and an outer sleeve face facing the borehole, each end of the expandable sleeve being connected with the casing part in two connections, and an annular space between the inner sleeve face of the expandable sleeve and the casing part, and wherein the annular projecting element may be arranged on an outer casing face adjacent at least the connection closest to the second end of the production casing string.

The annular barrier may further comprise a casing part, an expandable sleeve surrounding the casing part and having an inner sleeve face facing the casing part and an outer sleeve face facing the borehole, each end of the expandable sleeve being connected with the casing part in two connections, and an annular space between the inner sleeve face of the expandable sleeve and the casing part, and wherein the annular projecting element at least may constitue the one connection arranged closest to the second end of the production casing string.

Moreover, the annular projecting element may be arranged in each end of the expandable sleeve for connecting the sleeve to the casing part.

Additionally, the annular projecting element may constitute a connection part overlapping the ends of the sleeve so that the sleeve is sandwiched between the annular projecting element and the casing part.

Furthermore, the opening may have an angle in relation to a radial direction transverse to the longitudinal axis so that the hydrocarbon-containing fluid is guided into the production casing string in the angle different from 90°.

In this way, when entering the production casing string, the fluid may not be jetted directly into the wall opposite the opening, and therefore wear on the wall may be significantly reduced.

Also, the helical groove may have a cutting edge.

Further, the annular projecting element may comprise several grooves forming a helix about the longitudinal extension.

The annular projecting element described above may taper towards the second end of the production casing string.

The outer diameter of the annular projecting element may be the overall outer diameter of the production casing string.

Also, the opening may be arranged in the groove for letting fluid from the reservoir into the production casing string.

Furthermore, the production casing string may have an inner face along which a sliding sleeve may be slidably arranged for sliding between a closed position, in which the sliding sleeve may block the opening, and an open position, in which the fluid may be allowed to flow through the opening and into the production casing string.

The opening may be arranged closer to the first end of the production casing string than to the second end of the production casing string, or closer to the second end of the production casing string than to the first end of the production casing string.

Moreover, the groove may have an angle in relation to the longitudinal axis, wherein the angle may be 10-80°, preferably 25-75°, more preferably 35-55°.

Also, the groove may taper towards the first and/or second end of the production casing string.

Furthermore, the annular projecting element may have threads for being connected to the casing parts.

The invention also relates to a downhole production casing string system for completing a well downhole, comprising:

a production casing string according to any of the preceding claims, and a rotation equipment for rotating the production casing string along the helical groove as the production casing string is inserted into the borehole.

Finally, the present invention relates to a method of implementing a production casing string according to the invention in a borehole downhole, comprising the following steps:

connecting casing parts and at least one annular projecting element for forming the production casing string, entering the production casing string into the borehole as the casing parts are assembled, and rotating the production casing string along the helical groove as the production casing string enters the borehole.

Said method may further comprise the step of detaching part of a wall of the borehole from the wall by cutting in or hitting against the borehole wall by means of the annular projecting element.

Moreover, the method as described above may comprise the step of allowing fluid to flow from the borehole, in through an opening in the annular projecting element and into the downhole production casing string.

The method may further comprise the step of increasing an inner diameter of the borehole as the edge of the groove hits against the borehole wall.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
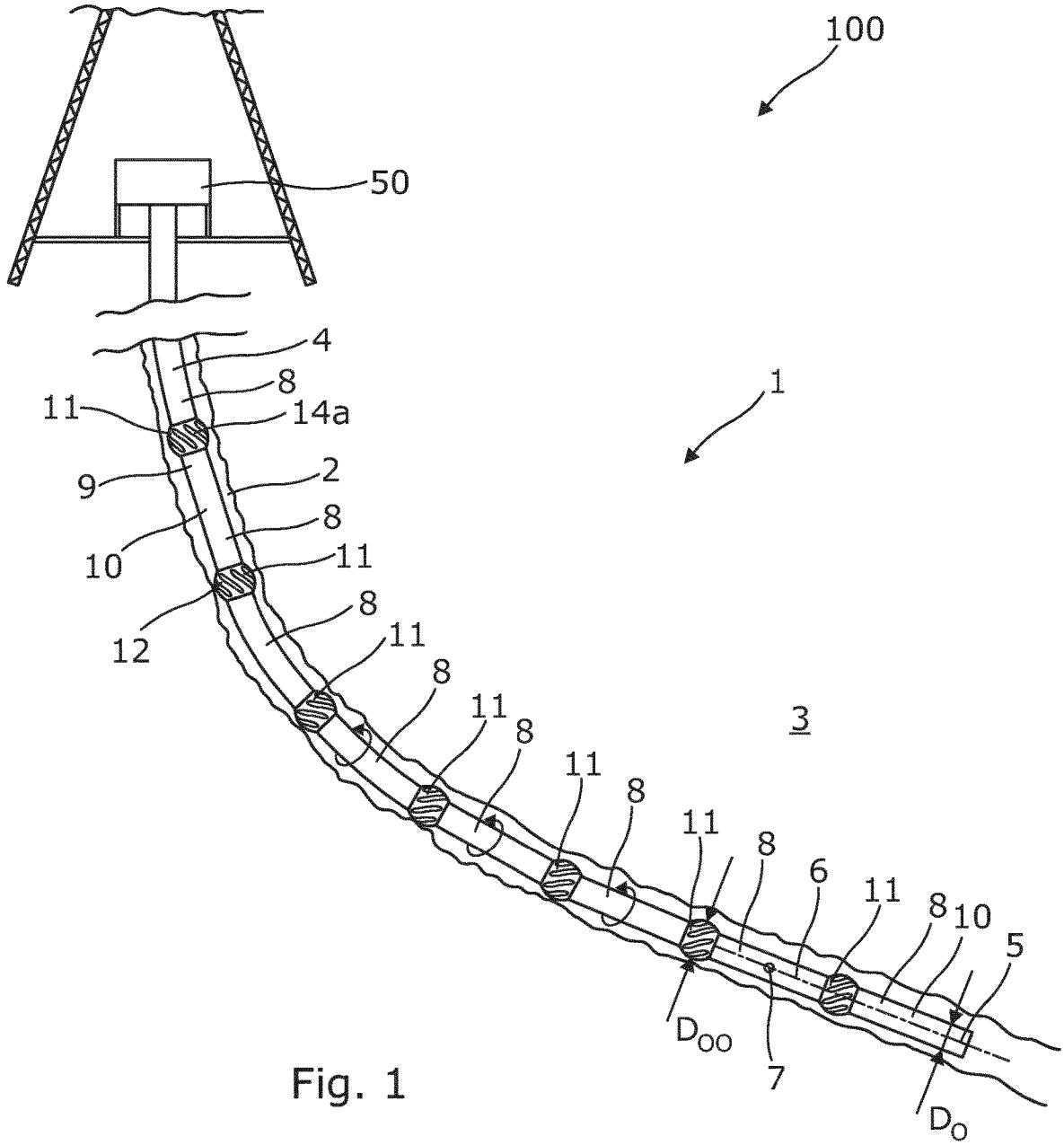
FIG. 1 shows a downhole production casing string system for completing a well downhole having a production casing string.

FIG. 1 shows a downhole production casing string 1 during insertion in a borehole 2 in a reservoir 3. The borehole has been drilled and the drill string pulled out of the well before the downhole production casing string 1 is inserted. The downhole production casing string has a first end 4 nearest a top of the borehole and a second end 5 furthest away from the top. The downhole production casing string extends along a longitudinal axis 6 which is substantially coincident with the longitudinal axis of the borehole. The downhole production casing string extends all the way to the top of the well but the first end 4 of the production casing string may also be connected with a drill pipe or another tubular for insertion of the production casing string into the borehole.

The downhole production casing string 1 comprises an opening 7 through which hydrocarbon-containing fluid is let into the downhole production casing string from the reservoir in order to produce oil or gas. The downhole production casing string is mounted from a plurality of casing parts 8. The casing parts have end sections 9 and a base section 10 between the end sections forming one pipe section. An annular projecting element 11 is arranged between the casing parts 8 connecting two adjacent casing parts. Each annular projecting element 11 has an outer face 12 and at least one helical groove 14*a* arranged in the outer face. The base section has an outer diameter $D_o$, and each annular projecting element 11 has an overall outer diameter $D_{oo}$ which is larger than the outer diameter of the base section, so that when the production casing string is inserted in the borehole, the annular projecting elements 11 are the elements hitting against the wall of the borehole. The string is rotated as indicated by the arrows, and since each annular projecting element 11 has helical grooves, the annular projecting elements 11 function as a screw easing the implementation of the production casing string in the borehole. When drilling a borehole, the wall has a lot of rock projections which may prevent free passage of known production casing strings. By having annular projecting elements 11 with a helical groove, the production casing string can easily be screwed past these borehole projections, and thus the risk of the production casing string getting stuck in the borehole during insertion is substantially reduced. Furthermore, when inserting the production casing string, the annular projecting elements 11 may hit against the borehole projections and in this way release the tip of the borehole projection from the remaining part, easing the passage of the production casing string further down the borehole. In this way, the annular projecting elements function to even out some of the irregularities of the borehole during the insertion of the downhole production casing string. As the production casing string is inserted and the annular projecting elements hit against the rock projections, the annular projecting elements 11 of the production casing string also protect other completion components in the production casing string by clearing the path.

The downhole production casing string system 100 shown in FIG. 1 comprises the aforementioned production casing string and a rotation equipment 50 for rotating the production casing string along the helical groove as the production casing string is inserted into the borehole. The rotation equipment 50 is arranged on a derrick but may also be arranged on any suitable rig or vessel. The casing parts are assembled with the annular projecting elements 11 above the rotation equipment 50 and subsequently inserted in the borehole, and new casing parts are mounted onto the production casing string 1.

Figure 2:
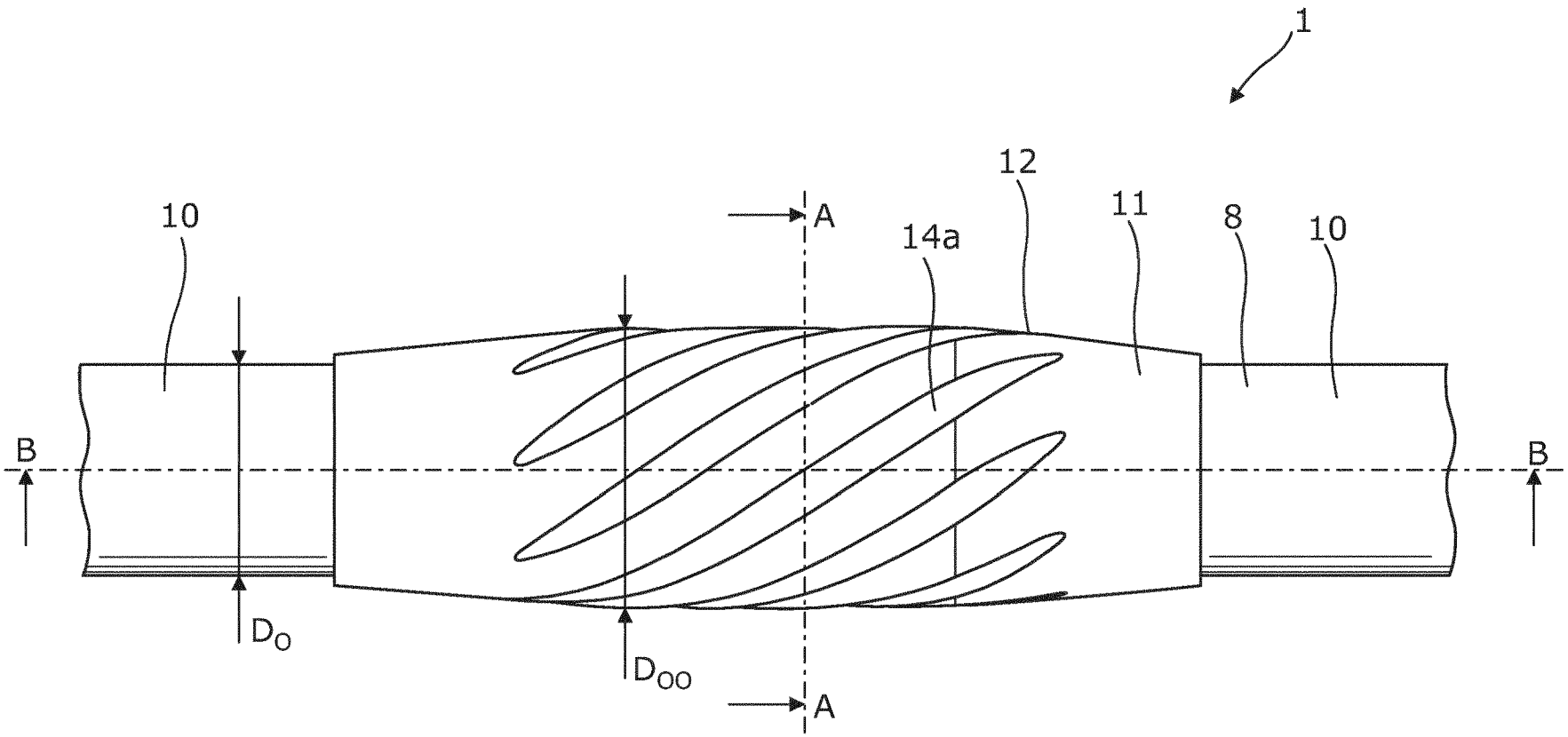
FIG. 2 shows an annular projection element as part of a casing collar.
Figure 3:
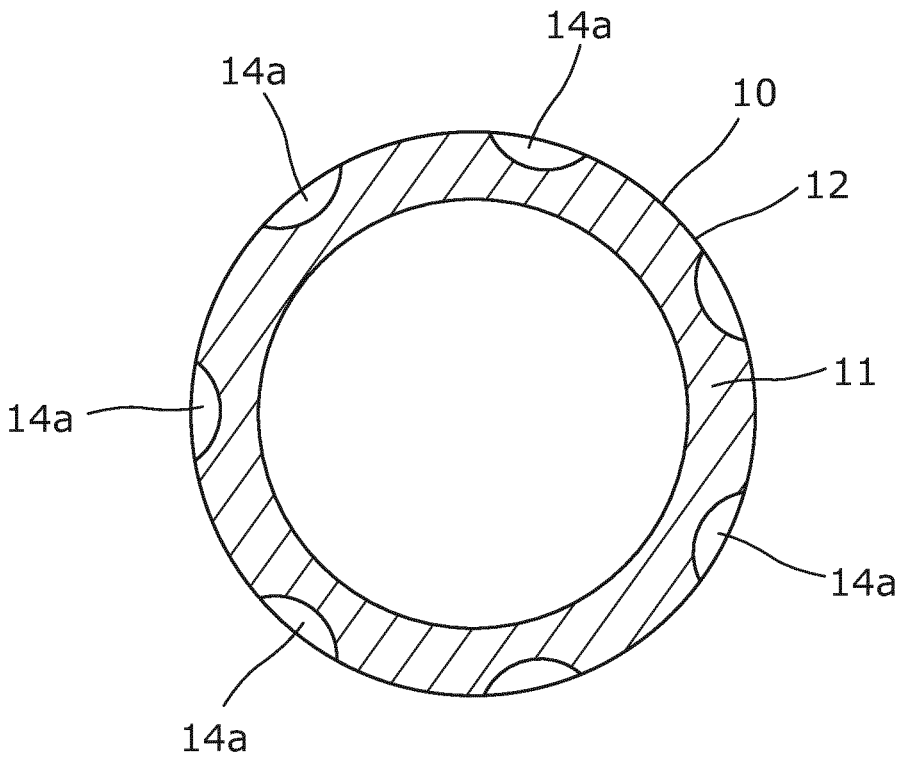
FIG. 3 shows a cross-sectional view of the production casing string of FIG. 2 transverse to a longitudinal extension.

In FIGS. 1 and 2, the annular projecting elements 11 are casing collars connecting the casing parts 8. The annular projecting elements 11 have helical grooves as shown in FIG. 2, where each groove extends partly around the outer face 12 of the annular projecting element 11 covering the whole circumference of the outer face 12 of the annular projecting element 11 as shown in cross-section in FIG. 3.

As shown in FIG. 2, the base section of the casing parts has an outer diameter $D_o$, and the annular projecting element 11 has an outer diameter which is the overall outer diameter $D_{oo}$ of the production casing string, and which is larger than the outer diameter of the base section of the casing parts.

Figure 4A:
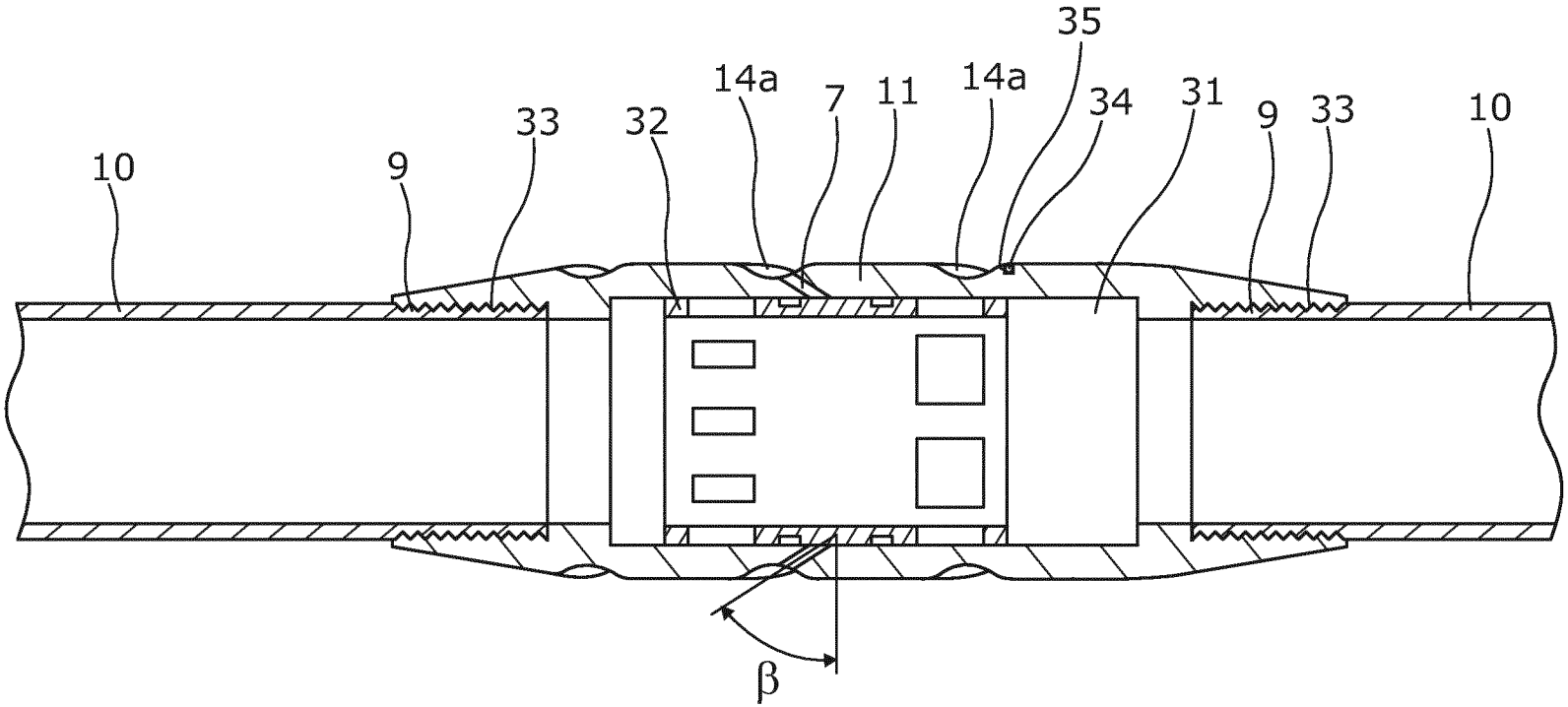
FIG. 4*a* shows a cross-sectional view of the production casing string of FIG. 2 along the longitudinal extension.

As can be seen in FIG. 4*a*, the casing parts have end sections 9 and a base section 10 between the end sections 9, and the end sections 9 are connected to the annular projecting elements 11 by a threaded connection. In one of the grooves, an opening is arranged for letting well fluid into the production casing string during production, or for jetting fracturing fluid out of the production casing string in order to fracture the formation. When the opening is used for production, the well fluid is allowed to flow along the groove, and the groove thus provides a fluid channel in the event that the annular projecting element 11 abuts the wall of the borehole. If the opening is used for letting out fracturing fluid and into the formation, the grooves are used for distribution of the fracturing fluid all the way around the circumference of the annular projecting element 11. As shown in FIG. 2, the groove tapers towards the first end and the second end of the production casing string, so that fluid can always flow into the groove.

The annular projecting element 11 has an internal groove 31 in which a sliding sleeve 32 is arranged, as shown in FIG. 4*a*. The sliding sleeve has indentations for matching a key tool in order to open and close the sleeve by sliding the sliding sleeve back and forth to cover and uncover the opening.

In FIG. 4*a*, the opening has an angle in relation to the longitudinal axis, shown as the opening having an angle β in relation to a radial direction transverse to the longitudinal axis, so that the hydrocarbon-containing fluid is guided into the production casing string in the angle different from 90°. The angle is approximately 45° in FIG. 4*a*, but in another embodiment, the angle may be 10-80°, preferably 25-75°, more preferably 35-55°. In this way, when entering the production casing string, the fluid is not jetted directly into the wall opposite the opening, and therefore wear on the wall is significantly reduced.

Figure 4B:
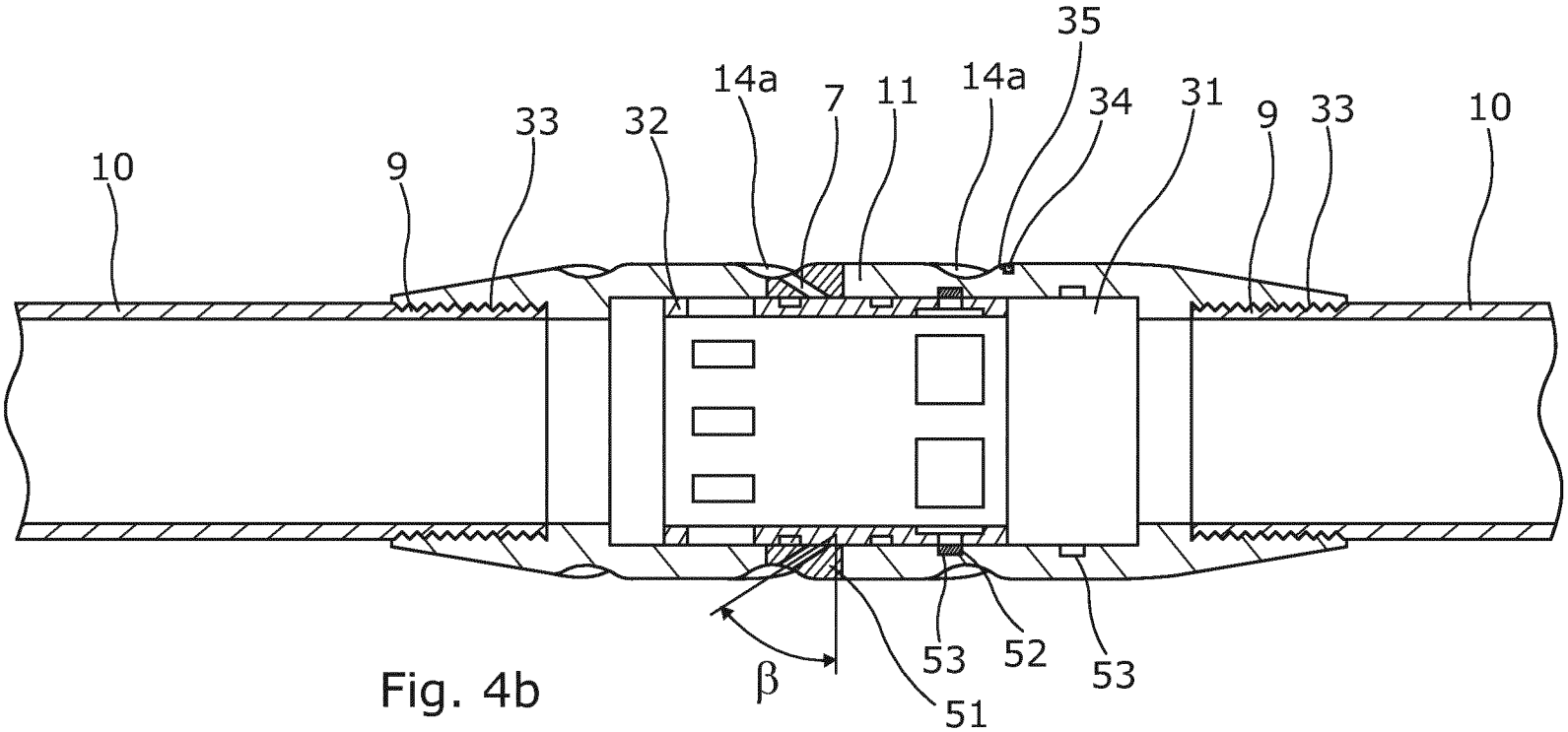
FIG. 4*b* shows a cross-sectional view of the production casing string along its longitudinal extension.

The angled opening may also be part of an insert 51 which is inserted in an opening in the annular projecting element 11 as shown in FIG. 4*b*. The insert may be made of ceramic material or tungsten carbide. The annular projecting element 11 further has indentations 53, matching dogs 52 or similar elements which are forced outwards by a spring, so that when the dogs of the sliding sleeve are arranged opposite an indentation 53, the dogs engage the indentation.

As can be seen in FIG. 1, the annular projecting element 11 tapers towards the first end 4 and the second end 5 of the production casing string. Thus, as shown in the cross-sectional view in FIGS. 4*a* and 4*b*, the annular projecting element 11 has a decreasing thickness towards the casing parts and in the area where the annular projecting element 11 and the casing parts engage by the threaded connection 33. The helical groove arranged closest to the second and bottom end of the production casing string is provided with a cutting edge 34, so that when the edge 35 of the groove hits against a projection in the borehole wall, that projection is cut off. Thus, while inserting the production casing string having annular projecting elements 11, the inner diameter of the borehole is evened out. By being able to even out the borehole, packers or annular barriers being part of the production casing string can more easily be successfully set later on, as they are to abut the wall of the borehole to provide the zone isolation.

Figure 5:
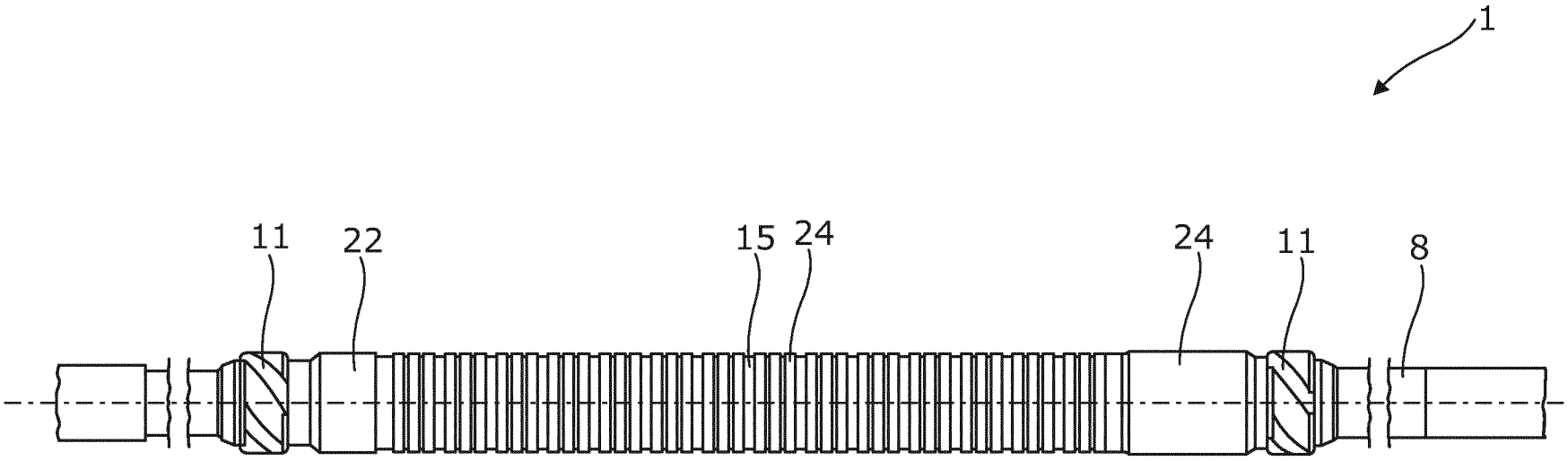
FIG. 5 shows a production casing string having an annular barrier.
Figure 6:
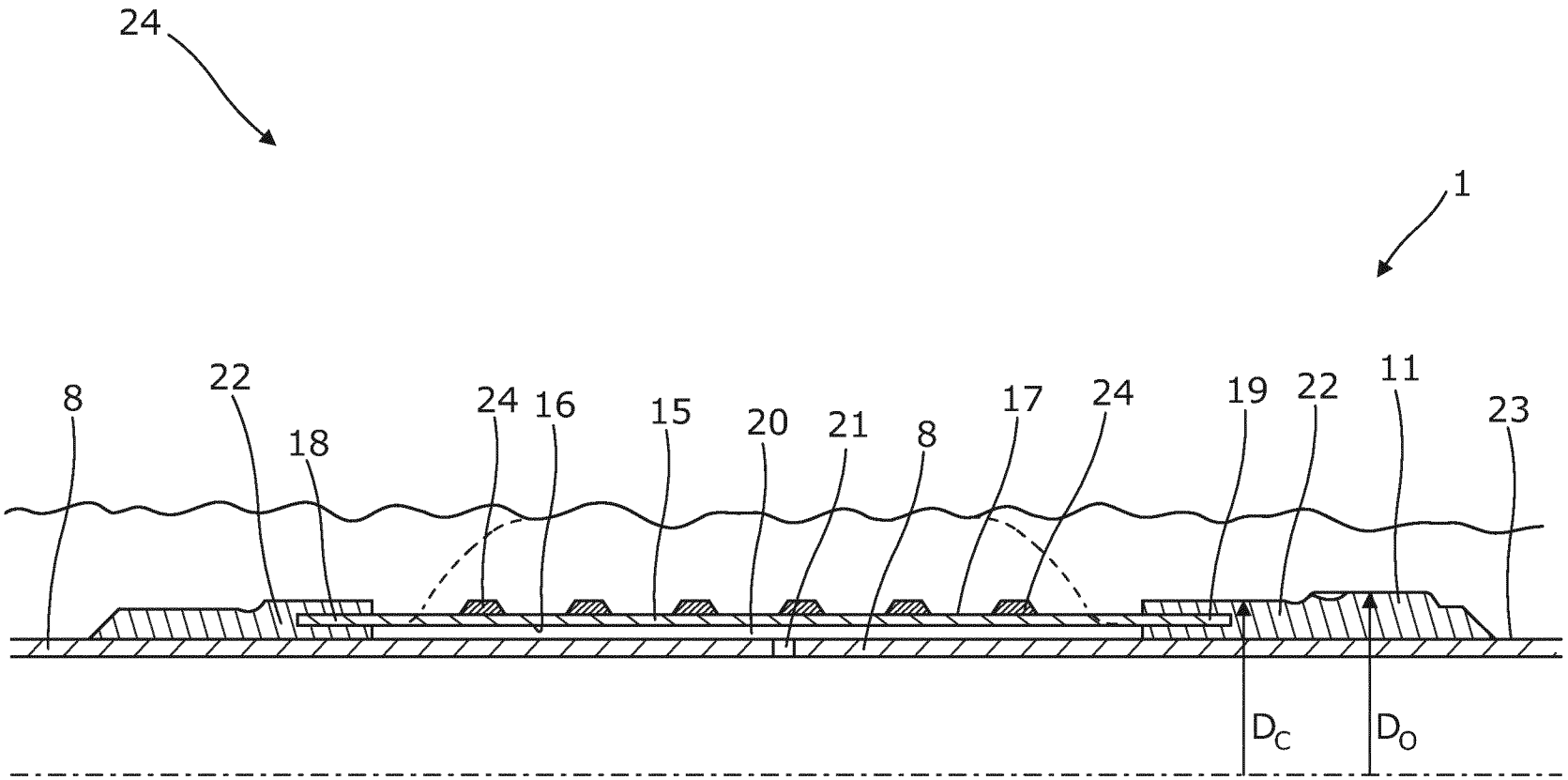
FIG. 6 shows a cross-sectional view of the production casing string having an annular barrier.

In FIG. 5, the annular projecting element 11 is part of an annular barrier. As shown in FIG. 6, the annular barrier comprises a casing part 8, an expandable sleeve 15 surrounding the casing part and having an inner sleeve face 16 facing the casing part and an outer sleeve face 17 facing the borehole. Each end 18, 19 of the expandable sleeve is connected with the casing part in two connections 22 defining an annular space 20 between the inner sleeve face of the expandable sleeve and the casing part. The annular projecting element 11 is arranged on an outer casing face 23 and constitutes one of the connections 22, namely the one connection closest to the second end of the production casing string and thus in front of the annular barrier, when inserted into the borehole. In FIG. 5, an annular projecting element 11 is arranged in each end of the expandable sleeve 15 for connecting the sleeve 15 to the casing part 8. As shown in FIG. 6, the annular projecting element 11 constitutes a connection part 22 overlapping the ends 18, 19 of the sleeve, so that the sleeve is sandwiched between the annular projecting element 11 and the casing part 8. The outer diameter of the annular projecting element 11 is larger than the outer diameter $D_o$ of the connections in the area overlapping the sleeve. Sealing means 24 are arranged on the outer face 17 of the sleeve 15 for providing a good seal against the borehole when the expandable sleeve is expanded by letting fluid into the space through the expansion opening 21 as indicated by the dotted line. The annular projecting element 11 of FIG. 6 has thus no opening in connection with the groove.

Figure 7:
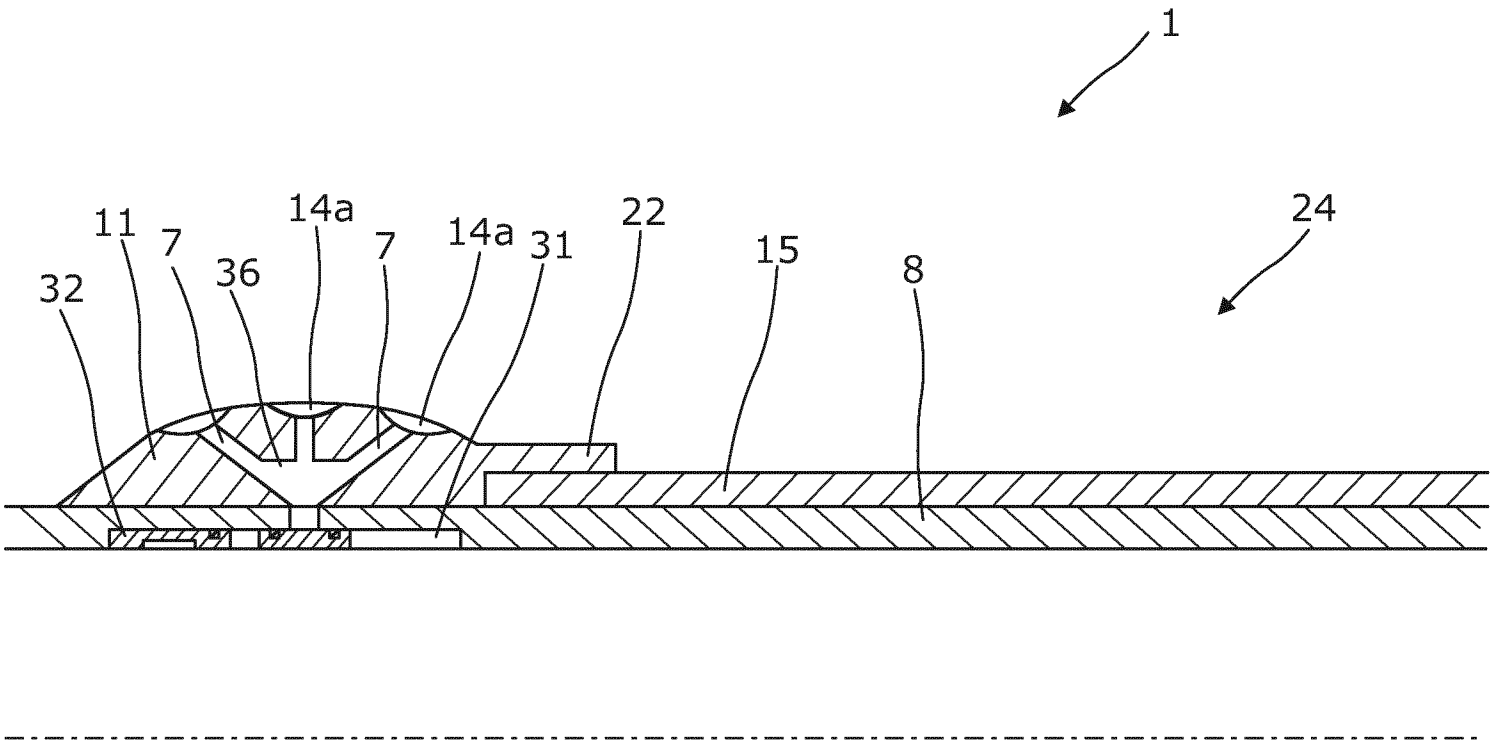
FIG. 7 shows a cross-sectional view of another annular barrier having an annular projection element.

In FIG. 7, the annular projecting element 11 is also part of the connection part 22 connecting the expandable sleeve to the casing part 8. Furthermore, openings 7 are arranged in each groove 14*a*. The openings are joined in a common flow channel in fluid communication with the inside of the production casing string if the sliding sleeve is in its open position. The sliding sleeve is shown in its open position in FIG. 7.

Figure 8:
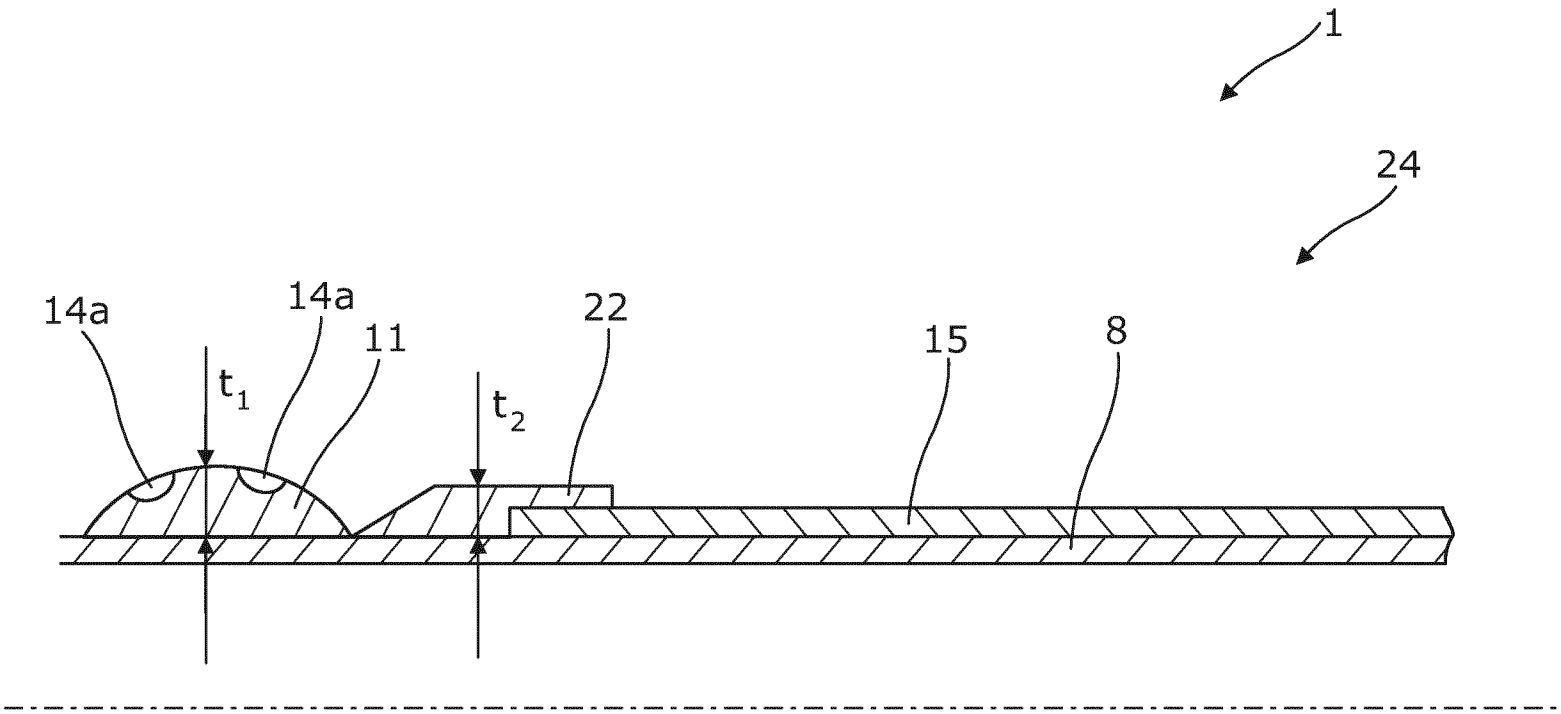
FIG. 8 shows a cross-sectional view of an annular barrier having another annular projection element.
Figure 9:
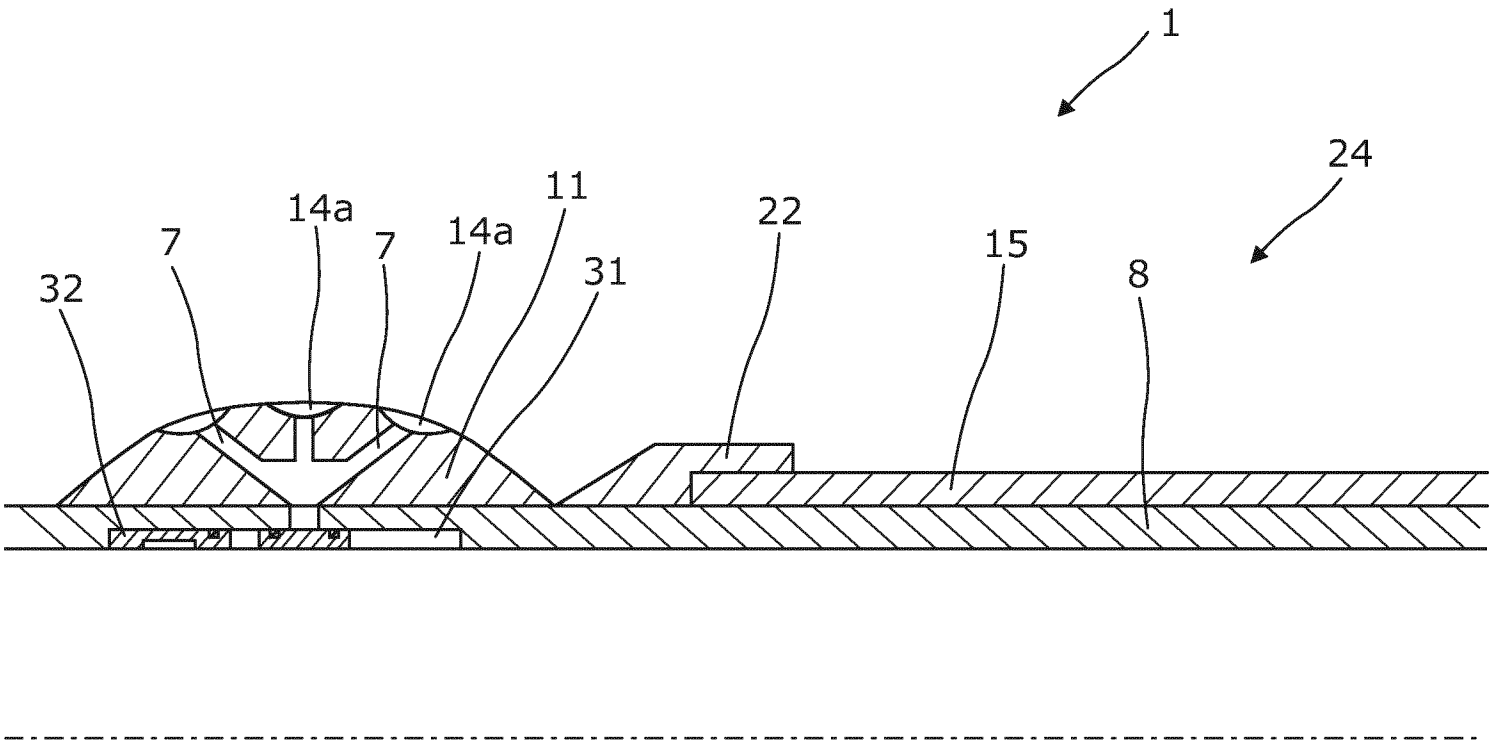
FIG. 9 shows a cross-sectional view of an annular barrier having another annular projection element.

The annular projecting element 11 and the connection 22 or connection part 22 may also be two separate elements as shown in FIGS. 8 and 9. The thickness $t_1$ of the annular projecting element 11 is larger than the thickness $t_2$ of the connection or connection part 22. In FIG. 9, the annular projecting element 11 is a separate component easily mounted on the outer face of the casing part in connection with an annular barrier in order to protect the annular barrier while the production casing string is inserted into the borehole. The annular projecting element 11 comprises a plurality of openings for jetting fracturing fluid or letting well fluid flow into the production casing string.

Figure 10:
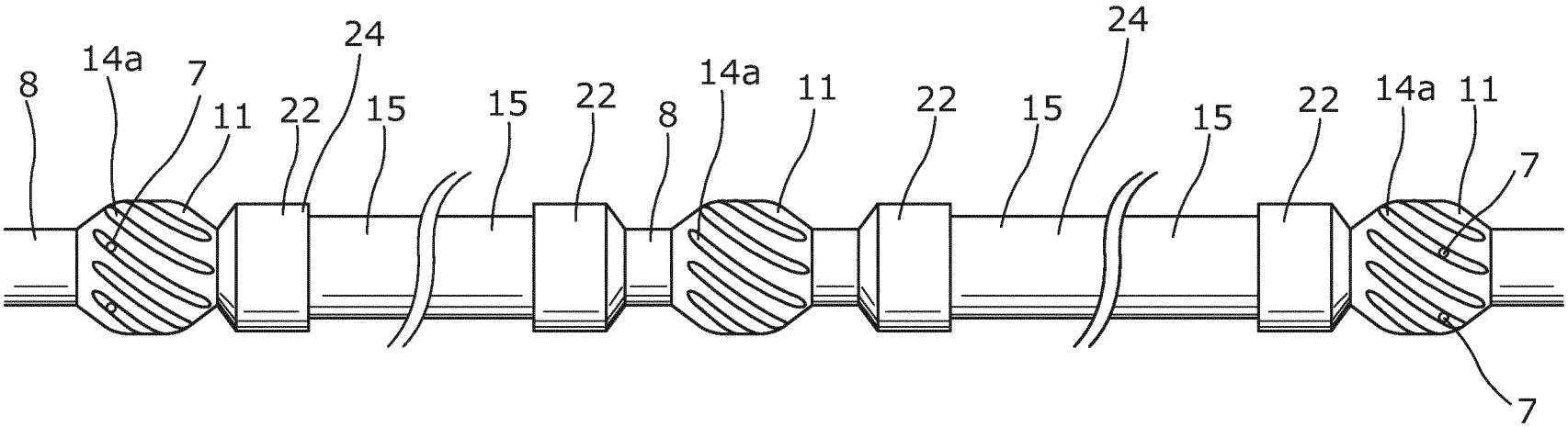
FIG. 10 shows a production casing string having two annular barriers.

FIG. 10 shows a production casing string having two annular barriers and three annular projecting elements 11 arranged between them. The number of annular projecting elements 11 depends on the length of each annular barrier, and thus the production casing string can be mounted to fit a variety of boreholes and completion designs.

As shown in the right side of FIG. 10, the opening 7 is arranged closer to the second end of the production casing string than to the first end of the production casing string. The openings may also be arranged closer to the first end of the production casing string than to the second end of the production casing string, as shown in the left side of FIG. 10. By having the openings arranged closer to the first end of the production casing string than to the second end of the production casing string, the openings are not filled with particles during insertion of the production casing string. By arranging the openings at a distance from the centre of the annular projecting element 11, the fluid may flow more easily into the production casing string.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. A downhole production casing string for insertion in a pre-drilled borehole in a reservoir, the downhole production casing string having a first end nearest a top of the borehole and a second end furthest away from the top, the downhole production casing string extending along a longitudinal axis and comprising:

at least one opening which during production allows hydrocarbon-containing fluid from the reservoir into the downhole production casing string, a plurality of casing parts having end sections and a base section between the end sections, the base section having an outer diameter, and at least one annular projecting element having an outer face and at least one helical groove arranged in or on the outer face and having an overall outer diameter which is larger than the outer diameter of the base section, wherein the at least one annular projecting element is fixed to the plurality of casing parts so as to rotate together during insertion of the string down the borehole, the helical groove being configured to act as a screw to rotatably engage one or more borehole projections remaining after drilling and tending to impede free passage of the string and to advance the string past the borehole projections, wherein the downhole production casing further comprises at least one fluid-expandable annular barrier, the annular projecting element being positioned in front of the annular barrier closer to the second end of the casing string, and wherein a diameter of the annular projecting element is larger than a diameter of the annular barrier before expansion of the annular barrier, so as to protect the annular barrier against damage when, following drilling, the annular projecting element and the annular barrier are together inserted into the borehole.

2. A downhole production casing string according to claim 1, wherein the annular projecting element is a casing collar connecting the casing parts.

3. A downhole production casing string according to claim 1, wherein the annular projecting element is arranged between two annular barriers.

4. A downhole production casing string according to claim 1, wherein the annular projecting element at least partly secures the at least one expandable annular barrier to one of the casing parts.

5. A downhole production casing string according to claim 4, wherein the annular barrier comprises a casing part, an expandable sleeve surrounding the casing part and having an inner sleeve face facing the casing part and an outer sleeve face facing the borehole, each end of the expandable sleeve being connected with the casing part in two connections, and an annular space between the inner sleeve face of the expandable sleeve and the casing part, and wherein the annular projecting element is arranged on an outer casing face adjacent at least the connection closest to the second end of the production casing string.

6. A downhole production casing string according to claim 4, wherein the annular barrier comprises a casing part, an expandable sleeve surrounding the casing part and having an inner sleeve face facing the casing part and an outer sleeve face facing the borehole, each end of the expandable sleeve being connected with the casing part in two connections, and an annular space between the inner sleeve face of the expandable sleeve and the casing part, and wherein the annular projecting element at least constitutes the one connection arranged closest to the second end of the production casing string.

7. A downhole production casing string according to claim 1, wherein the opening has an angle in relation to a radial direction transverse to the longitudinal axis so that the hydrocarbon-containing fluid is guided into the production casing string in the angle different from 90°.

8. A downhole production casing string according to claim 1, wherein the helical groove has a cutting edge.

9. A downhole production casing string according to claim 1, wherein the annular projecting element comprises several grooves forming a helix about the longitudinal axis.

10. A downhole production casing string according to claim 1, wherein the annular projecting element tapers towards the second end of the production casing string.

11. A downhole production casing string according to claim 1, wherein the outer diameter of the annular projecting element is the overall outer diameter of the production casing string.

12. A downhole production casing string according to claim 1, wherein the opening is arranged in the groove for letting fluid from the reservoir into the production casing string.

13. A downhole production casing string according to claim 12, wherein the production casing string has an inner face along which a sliding sleeve is slidably arranged for sliding between a closed position, in which the sliding sleeve blocks the opening, and an open position, in which the fluid is allowed to flow through the opening and into the production casing string.

14. A downhole production casing string according to claim 12, wherein the opening is arranged closer to the first end of the production casing string than to the second end of the production casing string, or closer to the second end of the production casing string than to the first end of the production casing string.

15. A downhole production casing string system for completing a well downhole, comprising:

a production casing string according to claim 1, and a rotation equipment for rotating the production casing string about the axis as the production casing string is inserted into the borehole.

16. A method of implementing a production casing string according to claim 1 in a borehole downhole, comprising:

connecting casing parts and the at least one annular projecting element for forming the production casing string, following drilling, entering the production casing string into the borehole as the casing parts are assembled, and rotating the production casing string and the at least one annular projecting element about the axis as the production casing string enters the borehole, the helical groove acting as a screw to engage the borehole projections and advance the string past the borehole projections as a result of rotation of the helical groove.

17. A method according to claim 16, further comprising detaching part of a wall of the borehole from the wall by cutting in or hitting against the borehole wall by means of the annular projecting element.

18. A method according to claim 16, further comprising allowing fluid to flow from the borehole, in through an opening in the annular projecting element and into the downhole production casing string.

* * * * *